US011002079B2

(12) United States Patent
Zaki et al.

(10) Patent No.: US 11,002,079 B2
(45) Date of Patent: May 11, 2021

(54) REAMING TOOL AND METHODS OF USING THE REAMING TOOL IN A WELLBORE

(71) Applicants: TERCEL IP LTD., Road Town (VG); TERCEL OILFIELD PRODUCTS BELGIUM SA, Gosselies (BE)

(72) Inventors: Magdy Zaki, Cairo (EG); Omar Mortagy, Cairo (EG); Ahmed Galal Abdel-Kader, Cairo (EG); Hossam Elbadawy, Katy, TX (US)

( * ) Notice: Subject to any disclaimer, the term of this patent is extended or adjusted under 35 U.S.C. 154(b) by 11 days.

(21) Appl. No.: 15/124,848

(22) PCT Filed: Mar. 10, 2015

(86) PCT No.: PCT/IB2015/051732
§ 371 (c)(1),
(2) Date: Sep. 9, 2016

(87) PCT Pub. No.: WO2015/136437
PCT Pub. Date: Sep. 17, 2015

(65) Prior Publication Data

US 2017/0175448 A1 Jun. 22, 2017

Related U.S. Application Data

(60) Provisional application No. 61/950,684, filed on Mar. 10, 2014.

(51) Int. Cl.

| | |
|---|---|
| ***E21B 10/30*** | (2006.01) |
| ***E21B 7/00*** | (2006.01) |
| ***E21B 10/50*** | (2006.01) |

(52) U.S. Cl.
CPC ..... *E21B 10/30* (2013.01); *E21B 7/00* (2013.01); *E21B 10/50* (2013.01)

(58) Field of Classification Search
CPC ..... E21B 10/30; E21B 10/34; E21B 10/345
See application file for complete search history.

(56) References Cited

U.S. PATENT DOCUMENTS

| | | | | |
|---|---|---|---|---|
| 1,844,371 | A | 2/1932 | Santiago | |
| 2008/0202818 | A1 | 8/2008 | McManus | |
| 2009/0145666 | A1 | 6/2009 | Radford et al. | |
| 2013/0133954 | A1* | 5/2013 | Mohon | E21B 10/28 175/345 |

OTHER PUBLICATIONS

PCT Search Report & Written Opinion (PCT/IB2015/051732), dated Jul. 7, 2015.

* cited by examiner

*Primary Examiner* — Robert E Fuller
(74) *Attorney, Agent, or Firm* — Pillsbury Winthrop Shaw Pittman LLP

(57) ABSTRACT

A reaming tool includes a tool body having a longitudinal axis and an upper end opposite a lower end and at least one blade extending outwardly from the external surface of the tool body. The blade includes a rolling element defining the gauge of the reaming tool, and a blade surface arranged undergauge of the rolling element and comprising a cutting surface.

20 Claims, 2 Drawing Sheets

REAMING TOOL AND METHODS OF USING THE REAMING TOOL IN A WELLBORE

FIELD

The present invention relates to the field of oil and gas exploration and development, and in particular to reaming tools and to the use of such reaming tools in a method of operation in a wellbore.

BACKGROUND

In the oil and gas industry, wells are formed using vertical and directional drilling techniques. The drilling process involves initially drilling a pilot borehole using a drill string with a drilling bottom hole assembly (BHA) having a drill bit at the leading end thereof. The pilot borehole must be subsequently reamed so as to accommodate casing, production pipe, etc., and to improve borehole gauge, shape and condition, using one or more reaming tools. The so formed well is then "completed", i.e. made ready for production by installing casing (if applicable), production pipes and associated tools and perforating and stimulating the bottom hole.

Generally, the drill bit is advanced downward until the drill bit has reached the target depth. The drillstring is then pulled out and a reaming BHA is attached at the leading end of the drillstring. This reaming BHA is then pushed downhole, reaming and conditioning the borehole prior to well completion and subsequently pulled out while at the same time reaming the borehole on the way out. As discussed above, this type of reaming requires a specific reaming run after the pilot hole has been created and prior to performing well completion, which is inconvenient and inefficient. The necessity to pull the drilling BHA out of borehole to replace it with a reaming BHA results in expensive non-production time.

Certain reaming tools currently available are only suitable for improving the borehole gauge in soft formations, and are less suitable for reaming hard formations. In most wellbores, the formation generally changes from soft to hard formation and vice-versa. Therefore there is a need for a tool and method providing a high borehole quality for both soft and hard formations. There is also a need for reducing excess torque caused while rotating the drillstring while the reaming surface is contacting the formation. Further, there is a need for a reaming tool that can be easily replaced or repaired after being subject to wear from use in a wellbore.

SUMMARY

According to a first aspect, the present invention relates to a reaming tool comprising a tool body having a longitudinal axis and an upper end opposite to a lower end, and at least one blade rising from the external surface of the tool body, said blade comprising a rolling element forming the gauge of the reaming tool and a blade surface arranged undergauge of the rolling element and comprising a cutting surface.

Preferably, the offset between the gauge of the reaming tool and the gauge of the blade surface is comprised between 1 mm and 20 mm.

Preferably, the blade surface comprises a first section comprising the rolling element and a second section gradually decreasing from an end of the first section towards the tool body.

Preferably, the blade further comprises a third section opposite to the second section, the third section comprising a second cutting surface, the third section gradually decreasing from a second end of the first section opposite to said first end, towards the tool body.

Preferably, the first section of the blade surface extends along the blade at a distance relative to the central axis of the tool comprised between a first point of the blade surface which is at the larger distance relative to the central axis and a second point of the blade surface which is comprised between the first point and at least 50% of the height of said gauge of the blade surface relative to the external surface of the tool body. In other words, a portion of the first section of the blade surface extends along the blade between two points: a first point of the blade surface which is at the larger distance relative to the central axis (2) on a first side of the rolling element and a second point of the blade surface which is comprised between the first point and at least 50% of the height of the gauge of the blade surface relative to the external surface of the tool body on the same side of the rolling element. Preferably, the first section of the blade surface is substantially parallel to the central axis.

Preferably, the second section of the blade surface comprises the cutting surface provided with one or more cutting elements disposed on at least a portion thereof, configured on said cutting surface at a radial distance from said longitudinal axis of the tool body less than or equal to the largest radial distance between the first section of the blade surface and the longitudinal axis of the tool body.

Preferably, the cutting surface comprises an arrangement of cutting elements extending from the vicinity of the external surface of the tool body to the vicinity of the first section of the blade surface.

Preferably, one or more cutting elements are configured on said cutting surface so that an extended longitudinal axis of said cutting element is positioned at an angle comprised between 0° and 85° with respect to a plane perpendicular to the longitudinal axis of said body.

Preferably, the cutting elements are positioned at a negative back rake angle.

Preferably, the rolling element comprises reaming elements.

Preferably, the first section of the blade surface comprises reaming elements which are undergauge relative to the gauge of the reaming tool.

Preferably, the rolling element has a rotation axis comprised in a plane parallel to the longitudinal axis of the tool body.

Preferably, the blade comprises a pocket in which is secured a cartridge comprising said rolling element.

Preferably, the cartridge comprises a first block and a second block supporting a shaft around which is arranged said rolling element.

Preferably, the first block and/or the second block is/are provided with reaming elements or hard material coating.

Preferably, the reaming elements are reaming inserts with a flat top.

DETAILED DESCRIPTION

Figure 1:
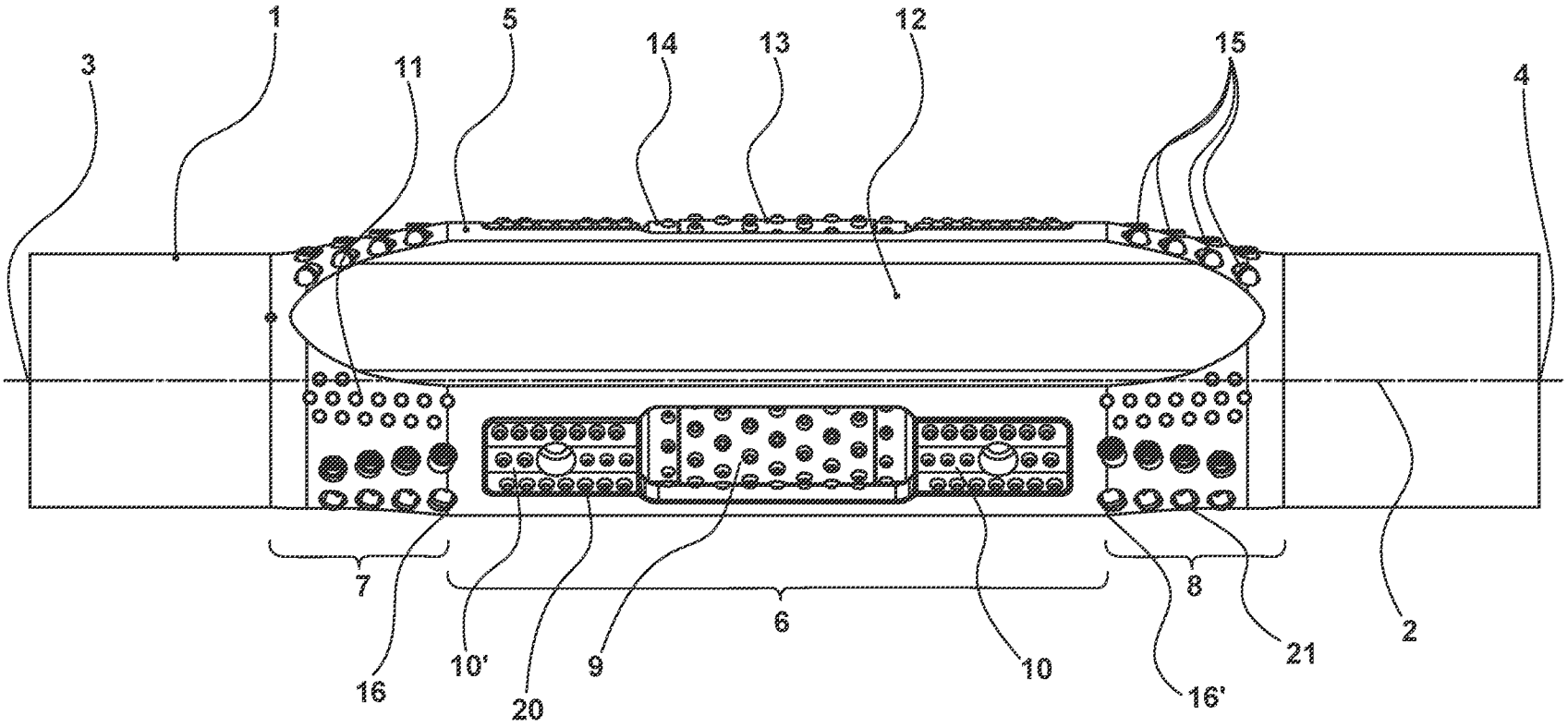
FIG. 1 shows a side view of a reaming tool according to an embodiment of the present invention.

FIG. 1 illustrates a reaming tool according to an embodiment of the present invention. The reaming tool includes a tool body 1 having a longitudinal axis 2, an upper end 3 opposite from a lower end 4, and at least one blade 5 extending outwardly from the external surface of the tool body 1. Preferably, the tool body 1 is substantially cylindrical. FIG. 1 shows a preferred embodiment of a reaming tool comprising three blades, preferably equally spaced by flutes 12. Alternatively, the blades may be unequally spaced. The reaming tool may have any number of blades. Each blade 5 comprises a rolling element 9 and a blade surface defining the outermost surface of the blade. The rolling element 9 defines the gauge of the reaming tool. The blade surface includes a cutting surface apart from the rolling element 9. The cutting surface has a smaller outer diameter than the rolling element 9. Preferably, the gauge of the reaming tool is offset from the gauge of the blade surface by between 1 mm and 20 mm, preferably between 1 mm and 10 mm, and more preferably between 2 mm and 8 mm.

Figure 2:
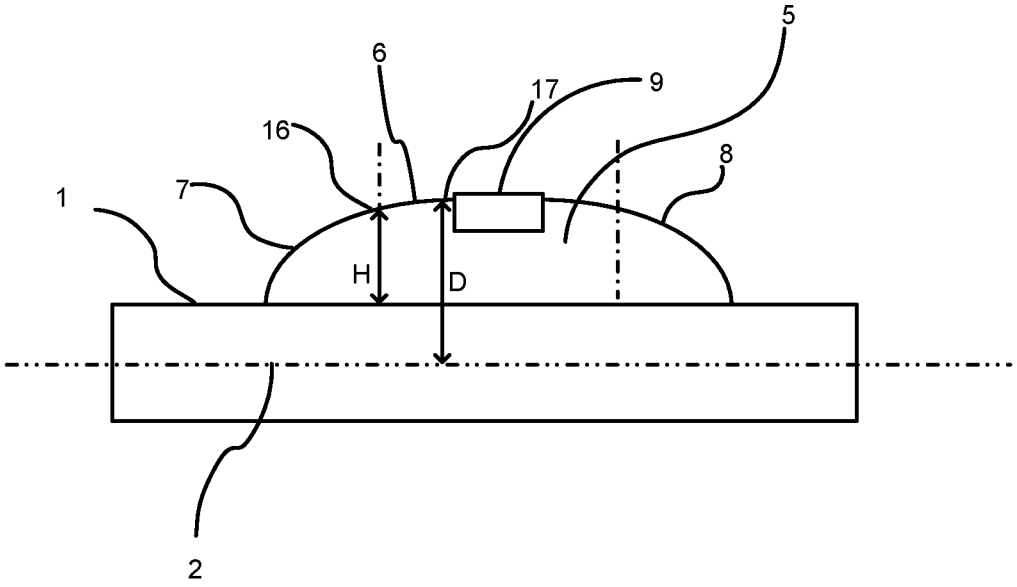
FIG. 2 is a simplified view of a reaming tool according to another embodiment of the present invention, wherein details including the reaming elements and the cutting elements are not shown.

The blade surface includes a first section 6 which includes the rolling element 9, and second and third sections 7, 8 gradually decreasing in diameter from ends of the first section 6 towards the tool body 1. As shown in FIG. 2, the first section 6 of the blade surface extends along the blade from point 16 to point 16' at a distance (D) relative to the central axis 2 of the tool. Distance (D) may vary between (1) a distance from the central axis to a first point of the blade surface at the largest diameter, and (2) a distance from the central axis to a second point 16 of the blade surface, where the second point 16 is located between the first point and at least 50% of the height (H) of the gauge of the blade surface relative to the external surface of the tool body 1, or preferably between the first point and at least 75% of the height (H) of the gauge of the blade surface relative to the external surface of the tool body 1, or more preferably between the first point and at least 90% of the height (H) of the gauge of the blade surface relative to the external surface of the tool body 1. FIG. 1 illustrates an embodiment of a first section 6 of the blade surface that is substantially parallel to the central axis 2 of the reaming tool, thus, the second point is at substantially the same height as the first point on the blade surface.

The rolling element 9 reduces friction between the blades 5 of the reaming tool and the walls of the borehole, thereby reducing the torque while rotating the drillstring in the wellbore. The rolling element 9 has a substantially cylindrical shape to stabilize the drillstring while rotating in the wellbore. Preferably, the rolling element 9 comprises reaming elements 13 such that the reaming elements indent the formation and break the formation by crushing the formation. More preferably, the reaming elements 13 are tungsten carbide inserts. Alternatively, the rolling element comprises milled teeth as reaming elements 13. The milled teeth rolling element is preferably made of steel and hardened by means of heat treatment such as a carburizing process or by means of a hardfacing treatment or by a combination of both treatments. In both types of rolling elements, the major force component on the reaming element 13 while crushing the formation is radial rather than tangential. Alternatively, the rolling element 9 may be devoid of any reaming elements. In one embodiment, the rolling element has a smaller diameter on both of its extremities 14 to engage the formation.

Preferably, the cutting surface 7, 8 comprises one or more cutting elements 15 disposed on at least a portion thereof. Preferably, the cutting elements 15 are polycrystalline diamond cutters (PDC). More preferably, the cutting elements 15 are configured on the cutting surface 7, 8 at a radial distance from the longitudinal central axis 2 of the tool body 1 less than or equal to the radial distance between the first section 6 of the blade surface and the longitudinal central axis 2 of the tool body. Reserve holes are located behind each cutting element 15 and are typically plugged by a dowel-pin 21. In the event a cutting element 15 is damaged, the dowel-pin 21 immediately behind the damaged cutting element is removed and a new cutting element is installed in the reserve hole. In this way, the cutting elements are one-time field redressable. Once most of the reserve cutting elements are damaged, the tool is sent to maintenance for major repair.

In one embodiment, the cutting elements 15 may be disposed at the vicinity of the edge of the blade in the direction of rotation of the reaming tool. For example, if the reaming tool comprises a cutting surface oriented towards the direction of drilling, the cutting elements are positioned at the vicinity of the edge of the blade entering the first in contact with the formation. If the reaming tool further comprises a cutting surface oriented towards the direction of pulling out of the hole, the cutting elements are disposed at the vicinity of the edge of the blade entering the first in contact with the formation. Preferably, the reaming tool comprises a first cutting surface 7 oriented towards the direction of drilling and a second cutting surface oriented towards the direction of pulling out of the hole. The reaming tool is preferably rotated following the same radial direction for both operations of drilling and pulling out of the hole, therefore the cutting elements are arranged at the vicinity of the edge of the blade at the same side of the blade.

Preferably, the cutting elements 15 are arranged on the cutting surface such that a first cutting element is provided at the vicinity of the external surface of the tool body and a second cutting element is provided at the vicinity of the first section of the blade surface. Preferably, the cutting surface comprises an arrangement of a plurality of cutting elements extending along the cutting surface from the vicinity of the external surface of the tool body to the vicinity of the first section of the blade surface. This arrangement of the plurality of cutting elements allows cutting any remaining ledges or tights spots before the wall of the borehole enters into contact with the first section of the blade surface and the rolling element. This arrangement of the plurality of cutting elements further prevents wear of the cutting surface. Advantageously, another arrangement of inserts 11 such as tungsten carbide inserts or diamond impregnated inserts or PDC inserts is provided on the cutting surface 7, 8 and behind the cutting elements 15 following the direction of rotation of the reaming tool, for reinforcing the cutting surface 7, 8 and preventing premature wear of the cutting surface.

Preferably, the cutting elements have a longitudinal axis and are oriented so that their longitudinal axis forms an angle comprised between 0° to 85°, preferably 10° to 45°, more preferably 15° to 30° with a plane perpendicular to the axis of the reaming tool.

More preferably, the cutting elements are positioned at a negative backrake angle, preferably between 5° and 30°, the back rake angle that is the angle between a cutter's face and a line perpendicular to the formation being drilled. When the leading edge of the cutting element is ahead of the perpendicular, the angle is, by definition, negative. When the cutter element has a positive back rake angle the angle between its cutting face and the surface of the formation to be drilled is more than 90°. When the cutter element has a negative back rake angle, the angle between its cutting face and the surface of the formation to be drilled is less than 90°.

Preferably, the blade comprises a first cutting surface for cutting towards the direction of drilling and a second cutting surface for cutting towards the direction of pulling out of the hole, the first cutting surface and the second cutting surface being located respectively at both opposite first end and second end of the blade, on both side of the first section of the blade surface.

Preferably, the first section of the blade surface further comprises stationary reaming elements, preferably tungsten carbide inserts or milled teeth, which are slightly undergauge relative to the outermost exposed reaming elements of the rolling element. Preferably, the top of the reaming elements of the rolling elements are contained into a cylindrical envelope of constant diameter. Preferably, the outermost reaming elements of the rolling elements forms the gauge of the reaming tool and are located at a radial offset from the top of the stationary reaming elements comprised between 1 mm and 20 mm, preferably 1 mm and 10 mm, more preferably 2 mm and 8 mm.

Preferably, the rolling element has a rotation axis comprised in a plane parallel to the longitudinal axis of the tool body.

Preferably, the blade comprises a pocket in which is secured a cartridge comprising said rolling element.

Preferably, the cartridge comprises a first block 10 and a second block 10' supporting a shaft around which is arranged said rolling element.

Preferably, the first block and/or the second block is/are provided with reaming inserts 20 such as tungsten carbide inserts or milled teeth. Alternatively, the first and/or second block of the cartridge is coated with a hard material such as tungsten carbide.

Preferably, the reaming inserts have a flat top, for example a truncated dome shaped tungsten carbide insert.

According to a second aspect, the present invention is related to a method of operating in a wellbore comprising the steps of providing a bottom hole assembly to a string, the bottom hole assembly preferably comprising a drill bit and providing a reaming tool as disclosed herein above in at least one location in the string upwards to the drill bit.

Preferably, the reaming tool used in the method comprises two cutting surfaces on both sides of a reaming section. A first cutting surface is oriented towards the direction of drilling for cutting the remaining ledges or tights spots or collapsed formation after the passage of the drill bit and before the reaming of the borehole with the reaming section upon rotation of the drill string. A second cutting surface is oriented towards the direction of pulling out of the hole for cutting the remaining ledges or tights spots or collapsed formation once that the drill bit has reached a certain location and that the drill string is pull out of the hole and before the reaming section reams a second time the borehole upon rotation of the drill string.

Advantageously, the reaming tool disclosed herein consumes less torque than currently available reaming tools while still providing the ability to cut any ledges or tights spots or collapsed formations. Another advantage of the present invention is that the reaming structure is now field-redressable. Once the rolling element is worn, the cartridge is unscrewed and a new cartridge is installed. Another advantage provided by the present invention is that the lifetime of the tool is longer as the reaming of the wellbore is mainly done by the cutting elements with the cutting surface. Any large ledges will be first cut by the cutting elements.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A reaming tool comprising:

a tool body having a longitudinal axis and an upper end opposite a lower end; and at least one blade extending outwardly from an external surface of the tool body, the at least one blade comprising:

a first section comprising a rolling element defining a gauge of the reaming tool, and a first cutting surface arranged undergauge of the rolling element, wherein a first set of cutting elements is disposed on at least a portion of the first cutting surface, and wherein the first set of cutting elements is arranged on the first cutting surface such that a set of tips of the first set of cutting elements are at a radial distance from the longitudinal axis of the tool body less than or equal to the gauge of the reaming tool;

a second section comprising a second cutting surface, wherein a second set of cutting elements is disposed on at least a portion of the second cutting surface, and wherein a distance from the longitudinal axis to the second cutting surface along the second section decreases from a first end of the first section towards the tool body;

a set of reserve holes on the second cutting surface, wherein each reserve hole of the set of reserve holes is plugged with a dowel pin of a set of dowel pins, and wherein each reserve hole of the set of reserve holes is positioned at a same axial position of the longitudinal axis of at least one cutting element of the second set of cutting elements; and a set of inserts on the second cutting surface, wherein each respective insert of the set of inserts has a different size from any of the second set of cutting elements, and wherein each insert of the set of inserts is at a same axial position of the longitudinal axis as a reserve hole of the set of reserve holes on the second cutting surface.

2. The reaming tool according to claim 1 wherein an offset between the gauge of the reaming tool and a gauge of the blade is between 1 mm and 20 mm.

3. The reaming tool according to claim 1, wherein the at least one blade further comprises a third section opposite to the second section, the third section comprising a third cutting surface, wherein a distance from the third cutting surface to the longitudinal axis gradually decreases from a second end of the first section opposite to the first end towards the tool body.

4. The reaming tool according to claim 1, wherein the distance between the first section and the longitudinal axis of the tool body ranges from:

a first distance corresponding to the largest diameter of the blade; to a second distance corresponding to at least 50% of a height of the gauge of the blade relative to the external surface of the tool body.

5. The reaming tool according to claim 1, wherein the first section of the blade is substantially parallel to the longitudinal axis.

6. The reaming tool according to claim 1, wherein the second set of cutting elements extends from a vicinity of the external surface of the tool body to a vicinity of the first section of the blade.

7. The reaming tool according to claim 1, wherein an extended longitudinal axis of each cutting element of the first and second sets of cutting elements are positioned at an angle between 0° and 85° with respect to a plane perpendicular to the longitudinal axis of the tool body.

8. The reaming tool according to claim 1, wherein the second set of cutting elements are positioned at a negative back rake angle.

9. The reaming tool according to claim 1, wherein the rolling element comprises reaming elements.

10. The reaming tool according to claim 1, wherein the first set of cutting elements comprises reaming elements which are undergauge relative to the gauge of the reaming tool.

11. The reaming tool according to claim 10, wherein the reaming elements are reaming inserts with a flat top.

12. The reaming tool according to claim 1, wherein the rolling element has a rotation axis comprised in a plane parallel to the longitudinal axis of the tool body.

13. The reaming tool according to claim 1, wherein the at least one blade comprises a pocket in which is secured a cartridge comprising said rolling element.

14. The reaming tool according to claim 13, wherein the cartridge comprises a first block and a second block supporting a shaft around which is arranged the rolling element.

15. The reaming tool according to claim 14, wherein at least one of the first block and the second block are provided with a hard material coating.

16. The reaming tool according to claim 1, wherein two extremities of the rolling element have a smaller diameter with respect to a middle portion of the rolling element between the two extremities, and wherein the two extremities comprise a set of reaming elements, and wherein the set of reaming elements comprise a set of tungsten carbide inserts or a set of milled teeth.

17. The reaming tool according to claim 1, wherein each insert of the set of inserts comprises a tungsten carbide material or a diamond material.

18. A method of operating in a wellbore comprising:

providing a bottom hole assembly to a string;

providing a reaming tool in at least one location in the string within or above the bottom hole assembly, the reaming tool comprising:

a tool body having a longitudinal axis and an upper end opposite a lower end; and at least one blade extending outwardly from an external surface of the tool body, the at least one blade comprising:

a first section comprising a rolling element defining a gauge of the reaming tool, and a first cutting surface arranged undergauge of the rolling element, wherein a first set of cutting elements is disposed on at least a portion of the first cutting surface, and wherein the first set of cutting elements is arranged on the first cutting surface such that a set of tips of the first set of cutting elements are at a radial distance from the longitudinal axis of the tool body less than or equal to the gauge of the reaming tool;

a second section comprising a second cutting surface, wherein a second set of cutting elements is disposed on at least a portion of the second cutting surface, and wherein a distance from the longitudinal axis to the second cutting surface along the second section decreases from a first end of the first section towards the tool body;

a set of reserve holes on the second cutting surface, wherein each reserve hole of the set of reserve holes is plugged with a dowel pin of a set of dowel pins, and wherein each reserve hole of the set of reserve holes is positioned at a same axial position of the longitudinal axis of at least one cutting element of the second set of cutting elements; and a set of inserts on the second cutting surface, wherein each insert has a different size from any of the second set of cutting elements, and wherein each insert of the set of inserts is at a same axial position of the longitudinal axis as a reserve hole of the set of reserve holes on the blade.

19. A reaming tool comprising:

a tool body having a longitudinal axis and an upper end opposite a lower end; and a blade extending outwardly from an external surface of the tool body, wherein the blade comprises a blade surface, and wherein the blade comprises:

a first section comprising a rolling element, wherein the rolling element defines a gauge of the reaming tool, and wherein the rolling element comprises a set of reaming elements, wherein each of the set of reaming elements comprises a set of tungsten carbide inserts or milled teeth; and a second section, wherein a distance from the longitudinal axis to the blade surface corresponding to the second section decreases from a first end of the first section towards the tool body, and wherein the second section comprises a second cutting surface of the blade surface, wherein the second cutting surface comprises:

a set of cutting elements, wherein the set of cutting elements comprises polycrystalline diamond;

a set of inserts, wherein each insert of the set of inserts is positioned at a same axial position as a cutting element of the set of cutting elements, and wherein each insert of the set of inserts has a young's modulus greater than or equal to that of tungsten carbide;

a set of reserve holes, wherein each respective reserve hole of the set of reserve holes shares an axial position with a respective cutting element of the set of cutting elements, and wherein the respective reserve hole is plugged with a cylindrical rod.

20. The reaming tool according to claim 19, wherein two extremities of the rolling element have a smaller diameter with respect to a middle portion of the rolling element between both extremities, and wherein the two extremities comprise at least one reaming element of the set of reaming elements.

* * * * *